US007161498B1

(12) United States Patent
Fan

(10) Patent No.: US 7,161,498 B1
(45) Date of Patent: Jan. 9, 2007

(54) VEHICLE POSITIONING APPARATUS

(76) Inventor: Xinyue Fan, 10440 Pioneer Blvd., Unit 3, Santa Fe Springs, CA (US) 90670

( * ) Notice: Subject to any disclaimer, the term of this patent is extended or adjusted under 35 U.S.C. 154(b) by 79 days.

(21) Appl. No.: 10/897,172

(22) Filed: Jul. 22, 2004

(51) Int. Cl.
*B60Q 1/48* (2006.01)

(52) U.S. Cl. ..... 340/932.2; 340/686.1; 340/942; 340/693.1

(58) Field of Classification Search ..... 340/932.2, 340/942, 988, 686.1, 686.2, 686.6, 693.1
See application file for complete search history.

(56) References Cited

U.S. PATENT DOCUMENTS 6,002,346 A 12/1999 Bowden et al.
6,154,150 A 11/2000 Laubach
6,218,962 B1 * 4/2001 Fiene ..... 340/932.2
6,531,966 B1 3/2003 Krieger
6,652,323 B1 11/2003 Yanda
6,882,128 B1 * 4/2005 Rahmel et al. ..... 320/101
6,933,655 B1 * 8/2005 Morrison et al. ..... 310/314
2002/0140576 A1 10/2002 Simon

* cited by examiner

*Primary Examiner*—Daryl C Pope
(74) *Attorney, Agent, or Firm*—Parsons & Goltry; Robert A. Parsons; Michael W. Goltry

(57) ABSTRACT

Vehicle positioning apparatus for facilitating the positioning of a vehicle in a specific position within an enclosure having an automatic door opening device with concurrently activated light source is disclosed. The vehicle positioning apparatus includes a light generating device mounted to the enclosure for generating a targeting mark. A photovoltaic cell generates electrical power from light emitted by the light source when the automatic door opening device is activated. The photovoltaic cell is coupled to the light generating device to provide electrical power for the generation of the targeting mark when the light is illuminated.

4 Claims, 2 Drawing Sheets

VEHICLE POSITIONING APPARATUS

FIELD OF THE INVENTION

This invention relates to vehicle positioning apparatus.

More particularly, the present invention relates to vehicle positioning apparatus utilizing visible light emitters.

BACKGROUND OF THE INVENTION

Positioning vehicles in enclosures, such as garages, is frequently difficult. Often, an operator of a vehicle will advance the vehicle too far, striking the rear wall of the enclosure which can cause damage to the wall and/or to the vehicle. Conversely, advancing a vehicle into an enclosure an insufficient distance can result in the rear of the vehicle projecting from the enclosure. The projecting rear of the vehicle will prevent garage doors, and the like, from closing. If unnoticed, the closing garage door may damage the vehicle, and/or the garage door. Thus, is highly desirable to position a vehicle properly within a parking enclosure.

Various apparatus have been developed for aiding in the positioning of a vehicle within a parking enclosure. These various apparatus often include laser devices for projecting a spot or line in a fixed position. This spot or line acts as a guide for the positioning of the vehicle. While effective, apparatus employing lasers require adequate power sources, such as battery packs or AC outlet connectors. Either of these can be inconvenient to use. Batteries die, requiring replacement, and power cords must extend along the wall and/or ceiling to an outlet. The use of a power cord may cause problems due to an outlet which may be inconveniently positioned. Additionally, to prevent continuous use of the positioning apparatus, resulting in unwarranted power use and undesirable wear on the laser device, a trigger mechanism must be employed to activate the positioning apparatus. Often, this includes a switch activated by the opening of a garage door or tripped by the entry of a vehicle. In either case, additional components, and installation are required.

It would be highly advantageous, therefore, to remedy the foregoing and other deficiencies inherent in the prior art.

SUMMARY OF THE INVENTION

Briefly, to achieve the desired objects of the present invention in accordance with a preferred embodiment thereof, provided is a vehicle positioning apparatus for facilitating the positioning of a vehicle in a specific position within an enclosure. The apparatus includes an enclosure, a light generating device mounted to the enclosure for generating a targeting mark, and a photovoltaic cell coupled to the light generating device to provide electrical power for the generation of the targeting mark.

In a particular aspect, an automatic door opener is carried in the enclosure and coupled to a door closing an entry to the enclosure for moving the door between an open position and a closed position. The light source is activated by actuation of the automatic door opener and provides the light converted to electrical power by the photovoltaic cell.

In yet another aspect, of vehicle positioning apparatus includes an enclosure having a door movable between an open position allowing vehicle access, and a closed position preventing vehicle access. An automatic door opener is carried in the enclosure and coupled to the door for moving the door between the open position and the closed position. A light source is activated by actuation of the automatic door opener. A light generating device mounted to the enclosure for generating a targeting mark. A photovoltaic cell generates electrical power from light emitted by the light source. The photovoltaic cell is coupled to the light generating device to provide electrical power for the generation of the targeting mark when the automatic door opener is actuated.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
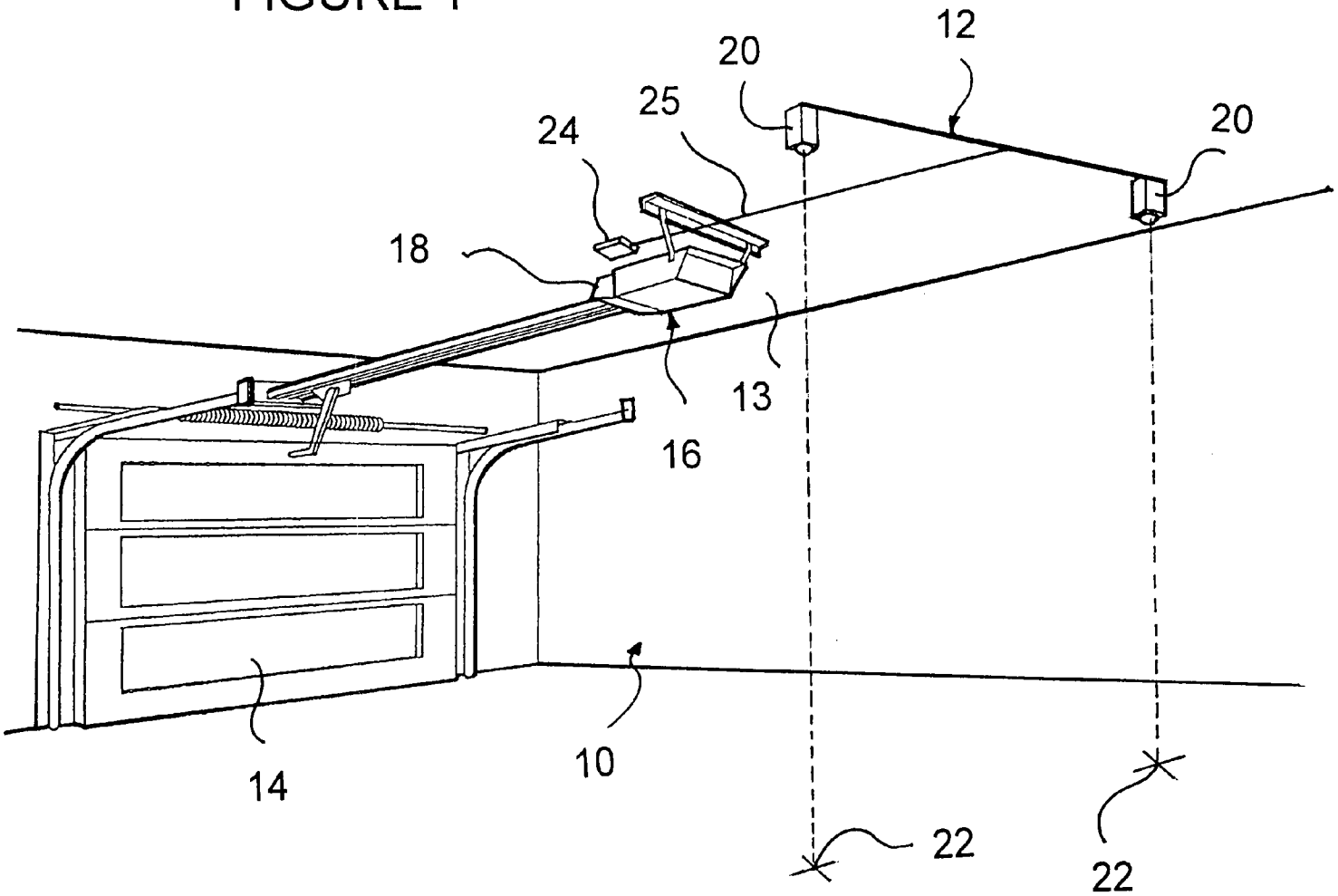
FIG. 1 is a partial perspective view of an enclosure having installed a vehicle positioning apparatus according to the present invention.

Turning now to the drawings in which like reference characters indicate corresponding elements throughout the several views, attention is directed to FIG. 1 which illustrates an enclosure 10 in which vehicles are positionable. Those skilled there will understand that enclosure 10 is substantially any closure in which a vehicle may be positioned, but in this illustration is a garage for containing two vehicles. It will also be understood that enclosure 10 may be a single car garage or a multiple car garage. Vehicle positioning apparatus, generally designated 12, is intended to be mounted within enclosure 10, having a ceiling 13 and an entry closed by a door 14. In the preferred embodiment, door 14 is movable between a closed position and an open position by an automatic door opening device 16 mounted to ceiling 13. These devices are typically referred to as garage door openers, and are actuated by a remote control carried by a vehicle operator. As the vehicle approaches the enclosure, the vehicle operator actuates automatic door opening device 16 using the remote control.

Actuation of automatic door opening device 16 moves door 14 from one position to the other, either opening or closing the entry to the enclosure. Actuation of door opening device 16 also typically results in the actuation of a light source 18. Light source 18 can be any conventional light source such as incandescent bulbs, fluorescent tubes and the like, and can be mounted anywhere in the enclosure. Conventionally, light source 18 is carried as part of automatic door opening device 16. When actuated by opening or closing door 14, light source 18 remains on for a period of time before automatically extinguishing.

Figure 2:
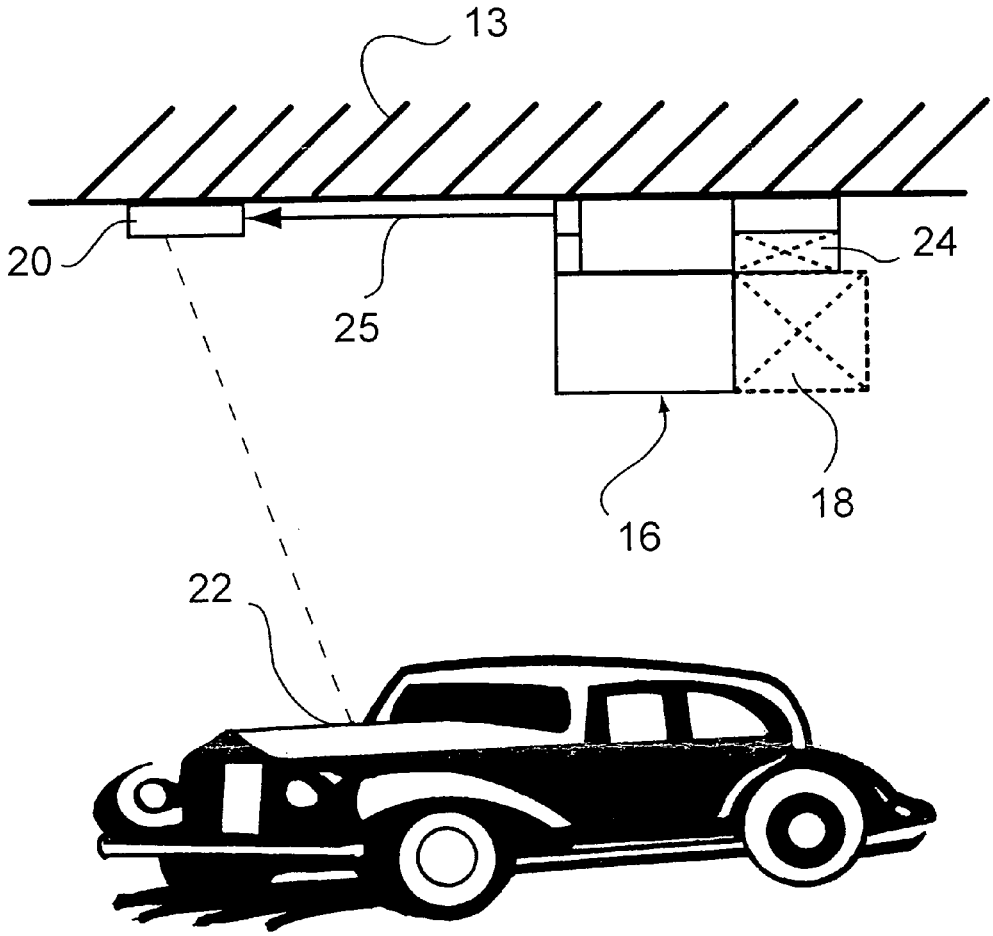
FIG. 2 is a schematic illustration of the vehicle positioning apparatus according to the present invention.

Still referring to FIG. 1, with additional reference to FIG. 2, vehicle positioning apparatus 12 includes a light generating device 20 mounted to enclosure 10 for generating a targeting mark 22. Light generating device 20 may be any device which generates a beam of light, but preferably is a laser or other focused beam source. In a preferred embodiment, a laser diode is utilized due to its low cost and low power consumption. While light generating device 20 may be mounted in substantially any location in enclosure 10, it is preferably mounted on ceiling 13 and directed downward therefrom. While this is the most efficient position, it will be understood that generating device 20 may be positioned in other locations such as on an upper portion of a wall of enclosure 10.

Light generating device 20 is powered by a photovoltaic cell 24 mounted proximate light source 18. One skilled in the art will understand that photovoltaic cell 24 may include one or more cells for converting light into electrical energy and the circuitry associated therewith for processing and providing the electrical power necessary. Additionally, the term "photovoltaic cell" is intended to include any device for converting photons to electrons, such as solar cells and the like. Photovoltaic cell 24 is preferably mounted to ceiling 13 directly above or on light source 18, and coupled via a conduit 25 to light generating device 20. In a preferred embodiment, photovoltaic cell 24 is mounted to the garage door opener facing the integral light source. Photovoltaic cell 24 converts light from light source 18 into available energy for the operation of light generating device 20. In its simplest form, apparatus 12 is unpowered with enclosure 10 in a dark condition. Upon actuation of automatic door opening device 16, light source 18 is activated, illuminating enclosure 10 and photovoltaic cell 24. Upon illumination, photovoltaic cell 24 provides electrical power to light generating device 20 which generates targeting mark 22. After a set period of time, light source 18 is extinguished, no longer providing light to photovoltaic cell 24 which stops producing electrical power, returning apparatus 12 to the unpowered condition.

Additional controls, such as switches or triggers, for operation of apparatus 12 are unnecessary. However, if desired, a control circuit can be added between photovoltaic cell 24 and light generating device 20 which includes a switch triggered upon a certain action which allows power to flow from photovoltaic cell 24 to light generating device 20. Various actions may be employed for the triggering of the switch to actuate apparatus 12. For example, actuation of automatic door opening device 16 may concurrently trigger the switch. Other actions may include a remote signal triggering the switch or a photo sensor which senses the illumination of light source 18.

In the most basic embodiment, light generating device 20, such as a laser diode, is mounted to ceiling 13 and directed downwardly to form targeting mark 22 when actuated. Light generating device 20 is coupled by wire 25 to photovoltaic cell 24 mounted above light source 18. The entire apparatus 10 may be positioned using adhesive tape, clips, pins or like fastening members. No batteries, electrical connections, or switches are required, and adjustment of targeting mark 22 is easily accomplished by repositioning light generating device 20. Additional light generating devices 20 can be employed and coupled to photovoltaic cell 24 for facilitating positioning of additional vehicles.

In operation, automatic door opening device 16 is actuated, moving door 14 from the closed to the open position. Upon actuation of automatic door opening device 16, light source 18 is activated, illuminating photovoltaic cell 24. Photovoltaic cell 24 converts light to electrical power and provides the electrical power to light generating device 20. Light generating device 20, now powered by photovoltaic cell 24, generates a targeting mark 22. As a vehicle is advanced into enclosure 10, target mark 22 begins impinging thereupon. When mark 22 reaches the selected location of impingement on the vehicle, the vehicle has been properly positioned. Door 14 can then be closed, or remain open. After a period of time, light source 18 is automatically extinguished. Photovoltaic cell 24, no longer having light to convert into electrical power, no longer supplies electrical power to light generating device 20.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. Vehicle positioning apparatus for facilitating positioning a vehicle in a specific position within an enclosure, the apparatus comprising:

an enclosure having a door movable between an open position allowing vehicle access, and a closed position preventing vehicle access;

an automatic door opener carried in the enclosure and coupled to the door for moving the door between the open position and the closed position;

a light source activated by actuation of the automatic door opener;

a light generating device mounted to the enclosure for generating a targeting mark; and a photovoltaic cell generating electrical power from light emitted by the light source, the photovoltaic cell coupled to the light generating device to provide electrical power for the generation of the targeting mark when the automatic door opener is actuated.

2. Vehicle positioning apparatus as claimed in claim 1 wherein the light generating device includes a laser device generating a downwardly directed beam of light.

3. Vehicle positioning apparatus for facilitating positioning a vehicle in a specific position within an enclosure having an automatic door opening device with concurrently activated light source, the apparatus comprising:

a light generating device mounted to the enclosure for generating a targeting mark; and a photovoltaic cell generating electrical power from light emitted by the light source when the automatic door opening device is activated, the photovoltaic cell coupled to the light generating device to provide electrical power for the generation of the targeting mark when the light is illuminated.

4. Vehicle positioning apparatus as claimed in claim 3 wherein the light generating device includes a laser device generating a downwardly directed beam of light.

* * * * *